United States Patent [19]

Bird et al.

[11] 4,366,217

[45] Dec. 28, 1982

[54] MOTION PICTURE FILM HAVING DIGITALLY CODED SOUNDTRACK AND METHOD FOR PRODUCTION THEREOF

[76] Inventors: George Bird, 85 Red Hill Rd., Princeton, N.J. 08540; Peter A. Custer, P.O. Box 100, Newtown, Bucks County, Pa. 18940

[21] Appl. No.: 278,688

[22] Filed: Jun. 29, 1981

Related U.S. Application Data

[62] Division of Ser. No. 88,465, Oct. 26, 1979, Pat. No. 4,308,327.

[51] Int. Cl.[3] ..... G03G 5/04

[52] U.S. Cl. ..... 430/11; 430/15; 430/17; 430/18; 430/56; 430/140

[58] Field of Search ..... 352/5; 252/301.16; 430/11, 15, 31, 54, 106, 109, 114, 119, 120, 124, 139, 140, 364, 17, 18, 56

[56] References Cited

U.S. PATENT DOCUMENTS

| | | | |
|---|---|---|---|
| 2,939,787 | 6/1960 | Giaimo | 430/5 X |
| 3,193,536 | 7/1965 | Wagner et al. | 430/139 X |
| 3,301,676 | 1/1967 | Tomarek | 430/124 |
| 3,313,626 | 4/1967 | Whitney | 430/302 |
| 3,743,503 | 7/1973 | Goldman et al. | 430/119 |
| 3,926,633 | 12/1975 | Custer | 430/140 |
| 3,945,822 | 3/1976 | Verhille | 430/54 |
| 4,070,577 | 10/1978 | Lewis | 430/109 X |
| 4,075,018 | 2/1978 | Custer | 430/140 X |

FOREIGN PATENT DOCUMENTS

| | | | |
|---|---|---|---|
| 43-26838 | 11/1968 | Japan | 430/120 |
| 46-8039 | 3/1971 | Japan | 430/124 |
| 1073433 | 6/1967 | United Kingdom | 430/109 |

*Primary Examiner*—Roland E. Martin, Jr.
*Attorney, Agent, or Firm*—Fidelman, Wolffe & Waldron

[57] ABSTRACT

A motion picture film having a plurality of digitally coded soundtracks which are colorless and transparent to visible light and which fluoresce when exposed to ultraviolet light, unexposed film for providing the product, and the method for producing the product and methods for producing the exposed and unexposed films. The soundtrack images which overlie at least a portion of the visible image area of the film are digitally coded on the film using an electrostatic imaging system to imprint a fluorescent toner. The toner may comprise a fluorescent polymer having covalently bonded 3-phenyl-7-(amido or imido)-coumarin or certain substituted stilbene or N-alkyl-4-aminonaphalimides.

5 Claims, 2 Drawing Figures

MOTION PICTURE FILM HAVING DIGITALLY CODED SOUNDTRACK AND METHOD FOR PRODUCTION THEREOF

This is a divisional of application Ser. No. 088,465, filed Oct. 26, 1979, now U.S. Pat. No. 4,308,327.

CROSS-REFERENCE TO RELATED APPLICATIONS

This application is related to application Ser. No. 585,164, filed June 9, 1975, now issued U.S. Pat. No. 4,075,018, which is a continuation-in-part of application Ser. No. 375,812, filed July 2, 1973, now issued U.S. Pat. No. 3,926,633,, and to copending application "Fluorescent Soundtrack Readout System" Ser. No. 088,471 of Custer and Bird filed concurrently herewith, which is incorporated herein by reference.

BACKGROUND OF THE INVENTION

The present invention is directed to a motion picture film wherein a layer containing colorless, transparent ultraviolet light excitable soundtracks is provided on one side of the film. This is a unique material bearing two completely independent imaging systems, the familiar silver halide system and an electrostatic system. The soundtrack images may cover the whole or part of either the front or back of the film and are coded in digital form. More particularly, the present invention is directed to the use of a two layer image receiving system to record soundtracks on a film to produce soundtracks which are substantially colorless and transparent to visible light, but fluoresce in the visible light spectrum when exposed to ultraviolet light. The soundtracks comprise a toner imprinted onto the film by means of the electrostatic imaging system.

Generally, in the prior art it has become standard procedure to provide a magnetic or optical recording track on the edge of a film adjacent the visible image when producing sound in motion pictures. The width of the track is a limiting factor since it can only be on an area not covered by the photographic image, and thus must be very narrow due to the limited width of the film. Further, when utilizing multiple analog sound tracks on a conventional 35 mm motion picture release print, there is not sufficient space on the film to provide reasonable soundtracks which have good signal to noise ratio, frequency response and high information density. The present invention, on the other hand, provides a film and a method of using such film that admits of recording the sound on the full width of a film, and thus provides improved reproduction of the sound.

A digital sound record requires a high density of information on the film. For example, a single soundtrack designed to deliver sound at 90 db. dynamic range and 0–20 KHz frequency range will require 50,000 or more 16-bit "words" or numbers per second. This amounts to more than 800,000 bit marks per second per track, or more than 4,800,000 bit marks per second for six tracks. With auxiliary timing and positioning information, and with some redundant information to allow for correction of individual bit-error, a total of about 7,500,000 bits per second is required. The area of silver halide film currently reserved for the analog soundtrack cannot sustain this level of information recording.

It is known to use various light systems, e.g., the system shown in U.S. Pat. No. 1,928,329 to Oswald, et al. and U.S. Pat. Nos. 3,508,015 and 3,522,388 to Miller.

However, these systems apparently do not recognize the possibility of recording both sound and images on the same area of the film. The patent to Oswald uses a black and white film and visible light through a lens to provide the sound system while the patents to Miller utilize light emitting diodes of varying types. The systems thus suffer from the same deficiency of good sound reproduction as is encountered in the magnetic strip or variable area analog optical type of motion picture soundtrack recording.

Further, the art sometimes accomplishes multiple sound source effects by using separate, but synchronously run, film strips or magnetic tape. These systems present serious technical problems such as maintaining sound and image synchronization between the two separately run systems, especially when the strip or tape of one of the two systems has a section removed for repair or other purposes. This film may be of the standard 16 mm, 35 mm or 70 mm size. In the present invention and use, a plurality of digital soundtracks imaged in a transparent, substantially colorless material which can be excited to fluorescence by ultraviolet light are superimposed over the visual image area. One ultraviolet soundtrack exciter source serves to energize, or cause to fluoresce, all of the soundtracks.

Because of the intrinsically limited quality of optical and magnetic analog soundtracks in standard use, the motion picture industry has been unable to effectively reproduce the detailed realism, presence and aural excitement achieved with high fidelity systems at home and at discotheques and concerts. The accuracy of sound reproduction accepted as standard on records and tapes cannot physically be contained in the analog optical track standardized 50 years ago in cramped and grainy space alongside Edison's inch-wide picture. Within this decade, given digital recording, the art of high fidelity sound reproduction will improve still further, putting the film industry in worse jeopardy of failing to provide sound of equal fidelity.

Digital coding enables complete digital sound handling, including mixing and editing, usually done on magnetic tapes, without tape hiss or noise or degradation of the sound signal accumulating through successive generations of the recording, mixing, editing, mastering procedure. With the sound signal reduced to plus/minus ("yes"/"no") bits and with parity check bits to monitor the entry of errors, the identity of successive reproductions can be assured. Thus, the present invention is further directed to a film having layers which accept such digitally coded soundtrack(s) as binary number data, permitting reconstruction with absolute precision.

The archaic analog soundtrack is a "picture" of the wave nature of sound and the detail of the analog sound information must inevitably be mixed together with the intrinsic defects of the recording medium. The distortion which is characteristic of the analog recording means and the noise imposed by the coarse silver grains of the film become inseparable from the desired high fidelity sound.

The essential difference in the digital sound record is that the integrity of the sound information exists separate and immune from the physical nature of the recording medium. It is the intent of fluorescent soundtracking to record a plurality of channels of digital sound across the photographic image space of film as transparent and colorless fluorescent digital words. In digital sound recording, the amplitude of the sound wave is "sampled", or measured, at discrete intervals at a clocked constant repetition rate, as, for example, 50,000 samples per second to record frequencies of up to 20,000 Hz. Each sample is next converted to, for example, 16 bit digital words with one or more parity check bits. The 16 bits of each word used to record the wave amplitude of the sample (the dynamic range) can write any integer between 0 and 65,535. This is considerably more information than can be derived from the compressed amplitude spike of the present standard optical analog soundtrack record that is submerged among silver grains.

A simple and inexpensive system is required for imprinting or imaging the fluorescent digital words of the system described above. One such system, suggested for its accuracy, simplicity and ready adaptability to digital coding, is an electrostatic imaging system. A common method for fixing the electrostatic image on a substrate is by heat fusion of a toner comprised of a polymer having a melting point lower than the substrate employed. For highest optical quality the toner image may be covered with a lacquer or polymeric overcoat which matches the visible refractive index of the toner particles. The overcoat may further function to more securely fix the digital image in place and to protect the data bits from abrading in the projector or elsewhere.

It is further necessary that the fluorescent material of the toner remain bound in the toner in order to maintain distinct markings on the film. Difficulties are encountered, however, in obtaining such a polymer toner which is also fluorescent. An ordinary brightener compound present at the required concentration may suffer fluorescence quenching or may "bleed" out of the toner particles and into the support materials. It has been suggested in the prior art to make fluorescent polymers having the fluorescent compound (brightener) covalently bound to a polymer backbone. In U.S. Pat. No. 3,193,536 it is suggested to prepare a vinyl-brightener monomer and copolymerize it into the growing backbone of a suitable majority polymer. These teachings, however, are unsuitable for preparing the compounds useful in the present invention. It is exceedingly difficult to control the distribution of the brightener residues along the polymer chain and with a high loading of the brightener, non-selective positioning along the polymer backbone leads to severe fluorescence quenching. Although the patent mentions systems loaded with up to 100 percent of vinyl-brightener, no mention is made of quenching difficulties or of strategies for avoiding them. All of the principal examples deal with brightener loadings of 0.1–0.2 percent by weight, which do not provide sufficient ultraviolet absorption and re-emission for a suitable toner for the present invention.

Further problems are encountered with this approach due to the tendency for the vinyl-brightener to self-polymerize even in the solid state and to photoinitiate polymerization at any time. Additionally, the relative reactivities in polymerization may be such as to incorporate all of the vinyl-brighteners together in the first polymer chain segments formed, or in the last chain segments. This leads to severe quenching.

A second approach to providing a fluorescent polymer suitable for the present invention is to synthesize a polymer having reactive groups suitable for binding to a selected group of the brightener molecule. Problems encountered here include gross alteration of the properties of original brightener, especially the absorption and fluorescence wavelengths and the fluorescence quantum yield.

In this approach the monomer reactive with the brightener molecule may be a material such as maleic anhydride, acrylyl chloride, or methacrylyl chloride, and, subject to reasonable relative reactivities, the whole array of ordinary vinyl monomers is available to complete the copolymer chain. Even a sparingly soluble brightener can then be slowly coupled to the completed polymer. This approach requires the scrupulous exclusion of water to avoid conversion of the reactive sites to unreactive acid functions. It also requires that one consider polymerization conditions and monomer pairs which maximize the separation of the reactive sites, and thus minimize possibilities for quenching.

It is the general consensus that liquid toner development gives the best approach to high resolution electrophotography. The suspending liquid of the toner must be moderately volatile so that it can be removed by mild heating or evaporation at the end of the process. Additionally, it must have a high electrical resistivity so as not to discharge the primary images formed on exposure or contact. Additionally, the toner material must be insoluble in the suspending liquid. The solid toner particles are charged, all positive or all negative, with respect to the liquid vehicle.

OBJECTS OF THE INVENTION

It is an object of the present invention to provide a means for imaging digital data on substrates, such as films, sheets or plates of plastic, which may or may not have other visible data or graphic representations thereon.

It is also an object of the present invention to provide a means for applying a soundtrack to a visibly exposed and developed film by creating an electrostatic image on the film and immediately contacting the film with fluorescent toner.

Still another object of the present invention is to provide an unexposed film having an image receiving system, capable of receiving the fluorescent toner of the invention and compatible with the photographic layers and processes for developing same.

A further object of the present invention is to provide a finished film that has sound recording on the full width thereof and in superposition with the visual image and that requires only a minimum of extra equipment or modification to reproduce this sound.

It is yet another object of this invention to apply digital data to a film by electrostatic imaging means prior to development of the visual image layers.

It is an even further object to provide a reliable method of replaying sound on motion picture film which may be accomplished with limited retrofitting and addition of digital to analog circuitry to conventional projection equipment.

A further object of the invention is to provide means for the recording of a multiplicity of permanently synchronized digital soundtracks or channels on a single motion picture film release print and thus create, in the theatre, high fidelity multiple source sound effects.

It is another object of the present invention to provide a digitally coded soundtrack data matrix, and particularly a soundtrack disposed across the visual image space of a motion picture film.

Another object of the present invention is to provide a digitally coded soundtrack using a colorless toner which fluoresces in the visible light region when exposed to ultraviolet light.

Still another object of the present invention is to provide a novel colorless toner polymer having physical and chemical properties consistent with the nature of the film layers and uses of the present invention.

It is also an object to provide a method of making the above-described soundtrack and film incorporating the soundtrack.

Other objects and advantages will become apparent from the following disclosure.

SUMMARY OF THE INVENTION

The present invention is directed to a system for recording information or data by creating an ordered pattern of electrically charged areas on a substrate, coating the substrate with a dry or liquid electrostatic imaging toner which is transparent under visible light but is fluorescent under ultraviolet light and has a charge opposite to that on the substrate, whereby the toner adheres to the charged areas and then fixing the toner to the substrate.

In a preferred embodiment, the present invention is directed to black and white or color photographic films having additionally coated thereon a light insensitive system or a photoconductive system capable of receiving a transparent, colorless ultraviolet excitable fluorescent material applied by means of an electrostatic imaging system. However, it is possible to employ this system with other substrates, including other plastic base image bearing films, such as those in use in aerial reconnisance photographs and X-rays. The system can also be used as a updatable additional record on microfilm.

The ultraviolet fluorescent material is applied in the form of digital indicia to provide the soundtrack of the motion picture film. The visually exposed and developed film is charged image-wise with an electrostatic imaging means having the soundtrack digitally coded therein. The digital electrostatic charge image is then used to collect an image deposit from a liquid toner made up of a suspended clear, transparent fluorescent compound(s), desirably a fluorescent polymer. The film may then be coated with a protective layer to ensure the integrity of the soundtrack and to eliminate light scattering from the toner deposit by overcoating and matching the refractive index of these particles.

DESCRIPTION OF THE DRAWINGS

The following figures will serve to schematically illustrate one embodiment of the present invention.

DESCRIPTION OF THE PREFERRED EMBODIMENTS

Figure 1:
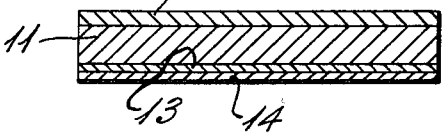
FIG. 1 is a cross-section of the film of the present invention in the unexposed state.

FIG. 1 shows a normal black and white or color film having a base 11 which may be of any usual material such as polyethylene terephthalate and a visible light sensitive emulsion 12 which may be either black and white or color. This is, the present invention is adaptable for either black and white films or color films. The particular type of visible image development required, such as dye coupling, etc., is not critical. That is, the film of the present invention may have any desired visible light-sensitive emulsion coated thereon. Most commonly the usual silver halide emulsions, either black and white or color types, will be employed. The visual image producing emulsion used in the present invention may be provided by numerous methods, one of these being the process for high speed laying of gelatin coatings disclosed in U.S. Pat. No. 3,617,292.

The present invention resides primarily in the provision on a silver halide film and the use of a two layer coating capable of receiving and recording information via electrostatic imaging means, and which can collect a toner deposit from a dry or liquid toner made up of clear, transparent material which fluoresces in the visible light spectrum when subjected to ultraviolet light.

The film shown in FIG. 1 has either no antihalation backing at all, a low density antihalation layer, or a removable antihalation layer positioned in the gelatin behind the visible light sensitive system. The absence of any antihalation layer implies that the visual image will be "wet-gate" printed, followed conventional methods to eliminate surface reflections and imperfections. In addition, the usual difficulties with halation will be eliminated by optically immersing the rear surface of the film against a matching dark dielectric object, such as a wheel having a gray glass surface. A two layer 13, 14 soundtrack forming system is opposite to the visible light-sensitive emulsions 12 on the base 11. The two layers comprise an inner conductive underlayer 13 approximately 1–2 microns thick and a clear dielectric or photoconductive outer layer 14 approximately 5–10 microns thick. The conductive underlayer may consist of an organic conductor such as DCR-77 (Dow Conductive Resin), a transparent evaporated inorganic conductor such as CuI, or a polymeric suspension of a transparent inorganic conductor. If the DCR-77 is used, the polyester film base is preferably conditioned with a corona discharge in air to promote adherence of the original conductor. The dielectric layer may be any of a large class of dielectric polymers, such as polycarbonate, styrene-methacrylate, polyester, etc. If a polymeric photoconductive outer layer is used, it may consist of a short wavelength dye-sensitized system such as found in Kodak SO-101 electrostatic film or in products such as XP5-004 made by Scott Graphics/James River Graphics Co. (see Zech, Appl. Optics, 16(6): 1642(1972)). Where possible, the use of the simpler dielectric layer for subsequent transfer of electrostatic charge image (TESI) is preferred, since the absorption of sensitizing dyes is absent, and one need not be concerned with minimizing dye absorption or adding compensating absorption to create a neutral color. (See R. M. Schaffert, "Electrophotography," Wiley, New York, 1975, especially pp. 167–176 for a variety of TESI techniques.) Similarly, the organic conductor is preferred, since it involves no materials of high refractive index and potential light reflection or light scattering.

Although it is preferred that the sound imaging system be on the back of the film, it is also possible to put this sound imaging system on the front, i.e., overcoat the visible emulsion with the sound emulsion. The provision of the sound imaging system on the same surface as the visual image emulsion requires no special processing other than the deposition of the sound imaging layers after the processes of development, washing and drying of the visible image, since the visible image system and the soundtrack system do not interfere optically with each other but the toner image is likely to interfere with permeation of water and silver halide processing reagents. Both locations of the soundtrack system on the film, e.g., on the back thereof and on the same surface as the image emulsion, are encompassed in the phrase "the soundtrack is superimposed over the photographic image area."

Figure 2:
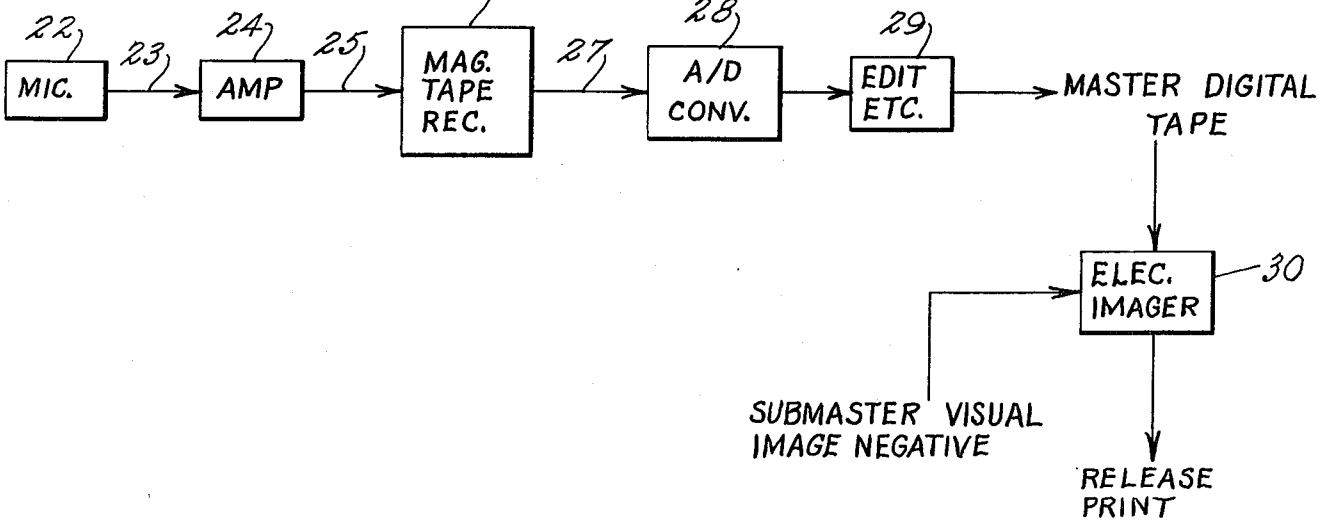
FIG. 2 is a schematic of a method for the preparation of a master negative and for using the master to apply an image to the final release print.

In FIG. 2 the process for making the soundtrack of the present invention is schematically illustrated. The visual image is recorded on a master negative (not shown) and the sound is usually recorded on an analog or digital magnetic tape, not necessarily made contemporaneously with the visual image. The sound record and photographic motion picture negative remain two separate entities until the final release print is made. The master visual negative is edited, spliced and used to create one or more generations of visual image sub-masters. It should be noted that sound may be recorded simultaneously by as many as 20–40 different microphones. Referring to FIG. 2, the sound is recorded by a plurality of microphones 22, transmitted by wires 23 to an optional amplification systems 24 and then by wires 27 to magnetic tape recorders 26. These sound tapes are then converted to digital tapes by analog to digital converters 28 which digital tapes are used for interim storage while further editing, mixing and processing are conducted (represented at step 29) to produce a master digital tape. As further shown in FIG. 2, the master digital tape is then fed to the electrostatic imaging system 30 of the invention to produce a final release print having the sub-master visual image negative on which the digital soundtrack from the master digital magnetic tape is printed as fluorescent indicia. It is the release print which is used in the projection booth of a motion picture studio to produce the visual images and soundtrack in the theater.

Superior sound recording may in some instances be obtained by eliminating the analog magnetic tape recorder 26 and going directly through the analog to digital converter 28 to a first digital recorder to create a multiplicity of digital records for later editing and mixing to create the master digital tape. The use of the finished master digital tape in subsequent steps is unchanged by this variation.

Direct printing of the digital images may be done with existing laser scanner printers, with cathode ray tube systems, or with optical printing, either contact or projection, to form the master sound negative. The master tape or edited master tape can be optically printed by projection or contact onto a succession of copies. Alternatively, the simple soundtrack image is projected on a charged photoconductive belt or drum, and the remaining image-wise charge is contact transferred to the assembly of dielectric and conductor. The imprinting is effected at a point on the film that is a discrete number of frames from the picture contemporaneous with the sound record, e.g., 30 to 40 frames behind the associated visual image in 35 mm films. Thus, a film having a visual image spaced 30 to 40 frames ahead of the sound associated with it is produced. This spacing can be used in the visual and sound reproduction of the films since it allows spacing between the audio and visual reproducing means in a projector.

Analog to digital sound converters known in the art may be utilized in this invention. In one embodiment of the present invention the converter codes six channels of digital sound. The frequency-time axis of the output of the amplifier 24 is "sampled" or separated into discrete measurements of wave height/amplitude information at a rate more than twice the highest frequency to be recorded. These measurements are then converted to, for example, 16 bit digital words. The 16 bits of each word, which can represent any integer between 0 and 65,535, provide a code comprised of many more distinctions than can be made from the compressed amplitude spike of the conventional analog soundtrack record. Following Nyquist's theorem there must be more than two samples taken for each cycle of the highest frequency to be reproduced. Thus, 50,000 samples/sec. reproduce 20,000 Hz sound.

The electrostatic imager utilized in the invention may be any of those known in the art, as, for example, the cathode ray imaging systems shown in Schaffert's "Electrophotography," Wiley, New York, 1975, pp. 154–155. The conductive mosaic faceplate CRT tube, sold by the Thomas Co. may also be used. Means for transferring the charge to the surface of the film may also include a belt, loop or master photoconductive charge film which can be charged, imaged and simply pressed against the two layer soundtrack forming system on the photographic film. The final electrostatic image is then used to collect an image deposit from a liquid toner bearing fluorescent compounds. Methods for pre-charging, imaging and toner processing in electrophotography are discussed in detail by Schaffert.

Toner material may be used which has the properties of being transparent and colorless in visible light, but fluorescent in the visible spectrum when exposed to ultraviolet light and which can be permanently inprinted onto the soundtrack forming system by means of the electrostatic imaging process described above. Another requirement is that the toner fluoresce with sufficient intensity to allow very rapid and easy discrimination by, for example, a photoelectric or photoconductive cell element. The ultraviolet sensitive materials suitable for use as toner material in the present invention include any material meeting these requirements.

The toner image may be further protected by an ultraviolet transparent index matching lacquer or overcoat, as described. Acceptable coatings include polymethylmethacrylate, polystyrene, Lexan polycarbonate (General Electric Co.), etc. in suitable solvents.

A particularly ideal toner material comprises a substantially transparent thermoplastic polymer or copolymer composition formed from vinyl or vinylidene monomers and containing ultraviolet fluorescing chromophore components, dispersed in a volatile, colorless, high resistivity liquid which is a non-solvent for the polymer or copolymer. The fluorescent polymer or copolymer is used in the form of substantially spherical beads having a diameter of from about 0.3 to 1 microns, all the beads having the same sign of electrical charge to prevent clumping and aggregation and so that all will be of opposite charge to the electrostatic image.

Liquids suitable for dispersing the fluorescent polymer include specially purified high resistivity kerosene, such as manufactured under the tradenames Sohio Solvent (Standard Oil of Ohio), Isopar (Exxon Corp., Houston, Tex.), etc. or freons such as Freon 113 (trichlorotrifluoroethane, duPont de Nemours & Co., Wilmington, Del.).

The fluorescent polymer must be loaded with a high concentration of brightener, for example, 1–10 weight percent, preferably 2–5 percent, and this must be accomplished without excessive quenching of fluorescence. At these high concentrations, it is imperative that the brigtener should not be able to "bleed" or migrate out of the toner particles and into the film system. Any such migration would quickly destroy the working contrast of the digital image data. Thus, systems in which the brightener is covalently bonded to the polymer backbone are highly preferred.

Because the classes of brighteners suitable for incorporation in the fluorescent polymer toner of the invention are very broad, they are best described in functional terms and properties. It is necessary that the brightener be a strong ultraviolet light absorber, having minimal absorption of E max=10,000 (moles/liter)$^{-1}$cm$^{-1}$, preferably a value of 20,000–50,000 at a wavelength of 420 nm. The absorption must fall away from the ultraviolet peak to an E<E max/10 at a wavelength of 420 nm. The brightener must be stable with respect to photoreaction and slow reactions, such as dark oxidation, and must fluoresce with a quantum yield (photons emitted/photons absorbed) of at least 10 percent and preferably 50–100 percent. The brightener must also admit of a covalent attachment to a polymer backbone. As discussed below, it may be reacted into a growing polymer or, preferably, added to reactive sites on an existing polymer. The chromophore may be formed or altered chemically according to plan in the attachment reaction. A typical chromophore will be loaded at a level of 1–10 percent by weight preferably 2–5 percent, relative to the polymer.

A particularly effective brightener for incorporation into the fluorescent polymers of the invention may be obtained from the yellow, blue-green fluorescing laser dye 3-phenyl-7-amino-coumarin (coumarin #10 in the Kodak series of laser dyes). Upon formation of a polymer-bound 7-amido- or 7-imido-function a colorless brightener is formed.

A class of particularly stable brighteners is obtained by forming 4-amides or 4-imides of compounds in the series of N-alkyl-4-amino naphthalimides. A representative precursor in this class is N-2-butyl-4-aminonaphalimide.

Compounds in the additional classes of 4-aminostilbenes may similarly be used to form bound amide or imide brighteners. Note, however, that difunctional compounds such as 4,4'-diamino-2,2'-stilbene disulfonic acid cannot be used at high concentration, as they will crosslink and rigidize the toner polymer to unacceptable degree. The useful amino stilbene derivatives will have an unreactive group on one end of the stilbene framework, as in the following:

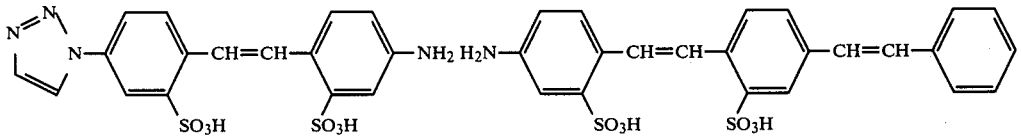

For preparation of these compounds, see Venkataraman, "Synthetic Organic Dyes," pp. 563 and 588.

The reactive polymer may be made in anticipation of a brightener precursor-amine being joined to any one of several amine-reactive sites. For example, these sites may be acid halide, diacid anhydride, or aldehyde functions derived from polymerized monomers such as acrylyl chloride, methacrylyl chloride, maleic anhydride, or acrolein. Somewhat less advantageously, amine sites on the polymer as derived from vinyl amine or 4-aminostyrene may be reacted with an acid chloride aldehyde or sulphonic acid chloride brightener-precursor.

A maleic anhydride: methyl-vinylether (1:1) copolymer (Gantrez AN-149, GAF Corp., New York, N.Y.) may be used as the backbone for the toner of the invention. The addition reaction to form 3-phenyl-7-amido-coumarin or 3-phenyl-7-imido-coumarin bound to the polymer was performed in dry, peroxide-free dioxane. The brightener-polymer is insoluble in heptane and other hydrocarbon solvents. The polymer was brilliantly fluorescent, while successive heptane washes were only very weakly fluorescent, proof that the brightener is bound to the polymer. The recovered solid polymer is also brilliantly fluorescent as the dried solid, and small, crushed particles also show the brilliant fluorescence.

However, this polymer still contained the great majority of anhydride groups which are expected to cause widely changing properties on gradual exposure to water vapor. Storage stability is thus anticipated to be a problem.

These problems can be overcome in two ways. First, the remaining anhydride groups can be reacted with a primary amine. Reaction with n-butylamine provides a brilliantly fluorescent, white, rubbery polymer suitable as the toner for use in the present invention. A wide variety of related alkyl vinylether monomers can be copolymerized with maleic anhydride and a variety of primary amines can be substituted after addition of the brightener groups to provide suitable toners.

An alternative approach to solution of the stability problem involves use of a lower concentration of maleic anhydride and to use monomers such as methylacrylate, methylmethacrylate, styrene, etc. as the other "majority" component. The majority monomer is used at 95–99 mole percent in relation to the reactive comonomer.

If a negatively charged toner is desired the anhydride (or acid chloride) mole fraction may be higher than the mole fraction of brightener to be added. After brightener attachment is completed, the addition of a trace of water will produce carboxylic acid groups on the residual acid precursors.

The importance of the tendency of maleic anhydride not to undergo self addition (see Handbook of Polymer Science and Technology, N. Bikales (ed.), Vol. 1 and the entry "Acids, Maleic and Fumaric") is that it establishes a minimum distance between chromophore units along the chain and so prevents the formation of sandwich dimers of the chromophore. These dimers are expected to be non-fluorescent, and to act as acceptors for Förster energy transfer, thus quenching the neighboring non-dimerized chromophores. A further desirable structural feature of the chromophore which can minimize dimer formation is the presence of some group lying out of the planar framework of the brightener group. In 3-phenyl-7-aminocoumarin this nonplanar group is the 3-phenyl group on the outward end of the molecule. The attached polymer chain performs the same function at the opposite end of the molecule.

The phenomenon of Förster transfer can also be used constructively to protect a system against excessive dimer quenching. When adding brightener to the reactive groups of a backbone polymer, it is quite easy to add a mixture of two brightener chromophores comprising a majority shorter-wavelength absorber to act as the Förster donor, and a minority of a longer-wavelength Förster acceptor. Since the acceptor is present in low concentration, very few acceptor dimers can form. This approach has been employed with Coumarin-10 as the acceptor-fluor, and 4-methyl-7-aminocoumarin as the absorber-donor, and a brilliantly fluorescent 1:1 maleic anhydride: methylvinylether polymer was obtained when 3.0 weight percent of 4 methyl-7-aminocoumarin and 0.58 weight percent of coumarin 10 were used.

The present invention may also be utilized with existing motion picture film projectors. The standard analog optical track on the film and the analog readout stage in the projector remains unchanged and can coexist with the complete digital system. In using the film of the invention the new digital sound readout stage is substituted for the disused magnetic soundtrack station of the projector.

It is to be understood that the term "motion picture release print" as used throughout the specification and claims includes reference to X-ray negatives and negatives used for other purposes such as aerial reconnaissance mapping, etc.

While the system will probably find its greatest use in connection with photographic films, it is obvious that the transparent fluorescent data matrices may be produced in the manner described on other substrates. Thus, they may be deposited on transparent bases, such as glass plates or plastic films, on opaque substrates such as ceramics, or metals coated with an insulating film. Where a transparent film or plate is the substrate, the face opposite the data matrix may have a graphic representation such as a picture, drawing or a diagram, or a printed or handwritten text. This can be projected on a screen, as by a slide projector, without interference from the transparent data matrix. On exposure of the data block to ultraviolet light in a readout/scanner the data can be readout. Specific examples of these other systems include aerial photographic military reconnaissance and surveying photographs as well as medical records and X-ray negatives. In aerial photographic military reconnaissance, for instance, it is necessary that each frame of exposed film be identified by time, longitude, latitude and altitude, and the heading and attitudes of the aircraft in relation to the ground be recorded at the instant the picture is exposed. The corresponding binary data matrices are photographically exposed on the film in real time to identify and locate each frame to carry this information and to enable the photograph to be readily retrievable from files.

What is claimed is:

1. An exposed and developed motion picture release print, comprising:

a base;

at least one visible silver image or color image layer on the base;

a two layer soundtrack image substrate substantially colorless and transparent to visible light comprising a conductive underlayer on the base and a dielectric or photoconductive overlayer contacting the underlayer, said soundtrack image sustrate overlaying at least a portion of the visible image;

wherein the soundtrack layer contains electrostatically imaged digitally coded soundtrack images which overlie the visible images; and the digitally coded soundtrack images are of a material which is colorless and transparent under visible light and capable of fluorescing under ultraviolet light.

2. The motion picture release print of claim 1, further comprising a coating of ultraviolet and visible light transparent material having a refractive index approximately the refractive index of the toner, said coating applied to the two-layer image substrate bearing the soundtrack images.

3. The motion picture release print of claim 1 wherein the visible image on the base is a color image.

4. The motion picture release print of claim 2 wherein the visible image on the base is a color image.

5. The motion picture release print of claims 3 or 4 further comprising an antihalation layer between the visible image layer and the base.

* * * * *